US010722738B2

(12) United States Patent
Heinen

(10) Patent No.: US 10,722,738 B2
(45) Date of Patent: Jul. 28, 2020

(54) SAFETY SYSTEM

(71) Applicant: Westinghouse Electric Company LLC, Cranberry Township, PA (US)

(72) Inventor: Thomas E. Heinen, Isanti, MN (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 0 days.

(21) Appl. No.: 16/038,242

(22) Filed: Jul. 18, 2018

(65) Prior Publication Data

US 2019/0022438 A1 Jan. 24, 2019

Related U.S. Application Data

(60) Provisional application No. 62/534,912, filed on Jul. 20, 2017.

(51) Int. Cl.
*A62B 35/00* (2006.01)

(52) U.S. Cl.
CPC ..... *A62B 35/0081* (2013.01); *A62B 35/0037* (2013.01); *A62B 35/0068* (2013.01); *A62B 35/0075* (2013.01); *A62B 35/0062* (2013.01)

(58) Field of Classification Search
CPC ..... A62B 35/0081; A62B 35/0037; A62B 35/0075; B61D 15/08; B61D 15/10
See application file for complete search history.

(56) References Cited

U.S. PATENT DOCUMENTS 1,395,559 A * 11/1921 Davis ..... B61D 15/10 104/245
3,553,746 A * 1/1971 Seiger ..... A61G 7/053 135/67
4,606,430 A * 8/1986 Roby ..... A62B 35/04 182/3
5,271,481 A * 12/1993 Rich ..... A62B 35/0081 182/3
5,325,788 A * 7/1994 Strickland ..... A62B 35/0056 104/119
5,526,896 A 6/1996 O'Rourke
5,537,933 A * 7/1996 Ablad ..... A62B 35/0087 104/119
6,311,942 B1 * 11/2001 Rotter ..... A61G 7/053 135/65
6,520,290 B1 * 2/2003 Carter ..... A62B 35/0037 182/3

(Continued)

FOREIGN PATENT DOCUMENTS

CA 2228429 A1 7/1999

*Primary Examiner* — Alvin C Chin-Shue
(74) *Attorney, Agent, or Firm* — K&L Gates LLP

(57) ABSTRACT

An improved safety system in accordance with the disclosed and claimed concept connects directly with the rail and advantageously provides both a fall resistance apparatus as well as a fall protection apparatus. The fall resistance apparatus provides a support that is movably situated on the rail and that can be manually grasped by the worker during the maintenance operation and which provides physical support in all directions to the worker. The fall resistance apparatus thus resists the likelihood that a fall will occur. In the unlikely event of a fall, the fall protection apparatus connects the worker directly to the rail and supports the worker from the rail at a location spaced above the floor, thus protecting the worker from injury in the event of a fall.

11 Claims, 6 Drawing Sheets

(56) References Cited

U.S. PATENT DOCUMENTS

| | | | | |
|---|---|---|---|---|
| 6,834,660 | B1 * | 12/2004 | Van Wart, Jr. | A61H 3/02 135/72 |
| 7,900,744 | B2 * | 3/2011 | McLaughin | A62B 1/04 182/36 |
| 8,105,179 | B1 * | 1/2012 | Allen | A63B 53/14 473/294 |

* cited by examiner

SAFETY SYSTEM

CROSS REFERENCE TO RELATED APPLICATION

The instant application claims priority from U.S. Patent Application Ser. No. 62/534,912 filed Jul. 20, 2017, the disclosures of which are incorporated herein by reference.

BACKGROUND

Field

The disclosed and claimed concept relates generally to overhead cranes and, more particularly, to a safety system that is usable in conjunction with an overhead crane.

Related Art

Overhead cranes are well known in the relevant art and are used in numerous applications. A typical overhead crane has an elongated bridge having a lifting apparatus that is movable among various positions along the longitudinal extent of the bridge. The bridge itself typically includes wheels at its ends that are situated on one or more elongated rails. The wheels are movable along the rails to move the bridge and the lifting apparatus among various positions within a facility in which the overhead crane is installed. The elongated rails may be generally linear, such as when used in an exemplary rectangular facility wherein the bridge is intended to move along the rails between one end of the facility and another. The elongated rails alternatively may be circular, such as when the bridge is intended to be situated across a diameter of a circular facility such as a nuclear facility and the wheels are intended to move among various diametrically opposed positions along the circumference of the circular facility. Such rails are regularly inspected for wear, corrosion, etc., and if some type of fault is found with the rail during an inspection operation, a maintenance operation or repair operation must be performed on the rail.

Since such rails are typically elevated above a floor by a substantial distance, measures must be taken in order to protect a worker who is visually inspecting the rail. For example, a scaffold can be built from the floor up to the rail, but the construction and disassembly of such a scaffold is expensive, and the floor where the scaffold is to be assembled typically must be clear of other structures, which can be difficult to achieve. Alternatively, a lifting machine can be employed of the type that is driven along the floor and which has a boom which lifts a cage that carries the worker to various elevated locations along the rail, but again the floor typically must be cleared in order to enable the vehicle to be moved as needed, which is very difficult in an industrial setting.

As such, another solution has been to install a safety cable along and above the rail, such as by mounting it to walls and the like, and to have the worker be physically connected with the safety cable via an umbilical connected with a safety harness. Such a strategy has its own shortcomings since the safety cable itself needs to be inspected, thereby creating the same problems as the inspection of the rail. Moreover, in a situation wherein the rail is disposed along an arcuate structure, such as inside the circular interior of a nuclear containment, the cable typically will be connected at discrete locations along an inner arcuate surface of the structure, but the portions of the safety cable between such discrete connection points will be spaced from the arcuate wall. The regions where the safety cable is spaced from the supporting structure create an unsafe situation by potentially dangling the worker over the interior of a nuclear containment, for instance, which is undesirable.

It has also been known to situate the worker on the bridge of the overhead crane and to cause the overhead crane to traverse the rail with the worker positioned thereon to perform the inspection operation. Such a methodology has numerous obvious safety shortcomings. Improvements thus would be desirable.

SUMMARY

As such, an improved safety system in accordance with the disclosed and claimed concept connects directly with the rail and advantageously provides both a fall resistance apparatus as well as a fall protection apparatus. The fall resistance apparatus provides a support that is movably situated on the rail and that can be manually grasped by the worker during the maintenance operation and which provides physical support in all directions to the worker. The fall resistance apparatus thus resists the likelihood that a fall will occur. In the unlikely event of a fall, the fall protection apparatus connects the worker directly to the rail and supports the worker from the rail at a location spaced above the floor, thus protecting the worker from injury in the event of a fall.

Accordingly, an aspect of the disclosed and claimed concept is to provide an improved safety system that is usable with an overhead crane.

Another aspect of the disclosed and claimed concept is to provide such a safety system that is connected with the rails of such an overhead crane.

Another aspect of the disclosed and claimed concept is to provide such a safety system that provides both a fall resistance apparatus as well as a fall protection apparatus wherein the fall resistance apparatus resists the occurrence of a fall, and wherein the fall protection apparatus avoids injury to the worker in the event of a fall.

Accordingly, an aspect of the disclosed and claimed concept is to provide an improved safety system usable by a worker during an inspection operation of a rail that is elongated, the rail having a base and further having a web that is situated atop the base. The safety system can be generally stated as including a fall resistance apparatus comprising a first trolley that is structured to be situated on the rail and a support that is situated on the first trolley, the support being elongated and being structured to extend in a generally upward direction from the first trolley, a fall protection apparatus comprising a second trolley that is structured to be situated on the rail and an umbilical that is connected with the second trolley, the umbilical being elongated and structured to be affixed to the worker at an end of the umbilical opposite the second trolley, and the first and second trolleys each comprising a frame having a number of engagement structures and a number of hooks, the frame being structured to be situated on the rail with at least some of the engagement structures of the number of engagement structures being engaged with an upper surface of the web and with the number of hooks being spaced below a lower surface of the web opposite the upper surface when the frame is free of lateral loading, at least a first hook of the number of hooks being structured to engage the lower surface and resist movement of the frame with respect to the rail when the frame is subjected to lateral loading and at least a first engagement structure of the number of engagement structures is at least partially disengaged from the upper surface.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
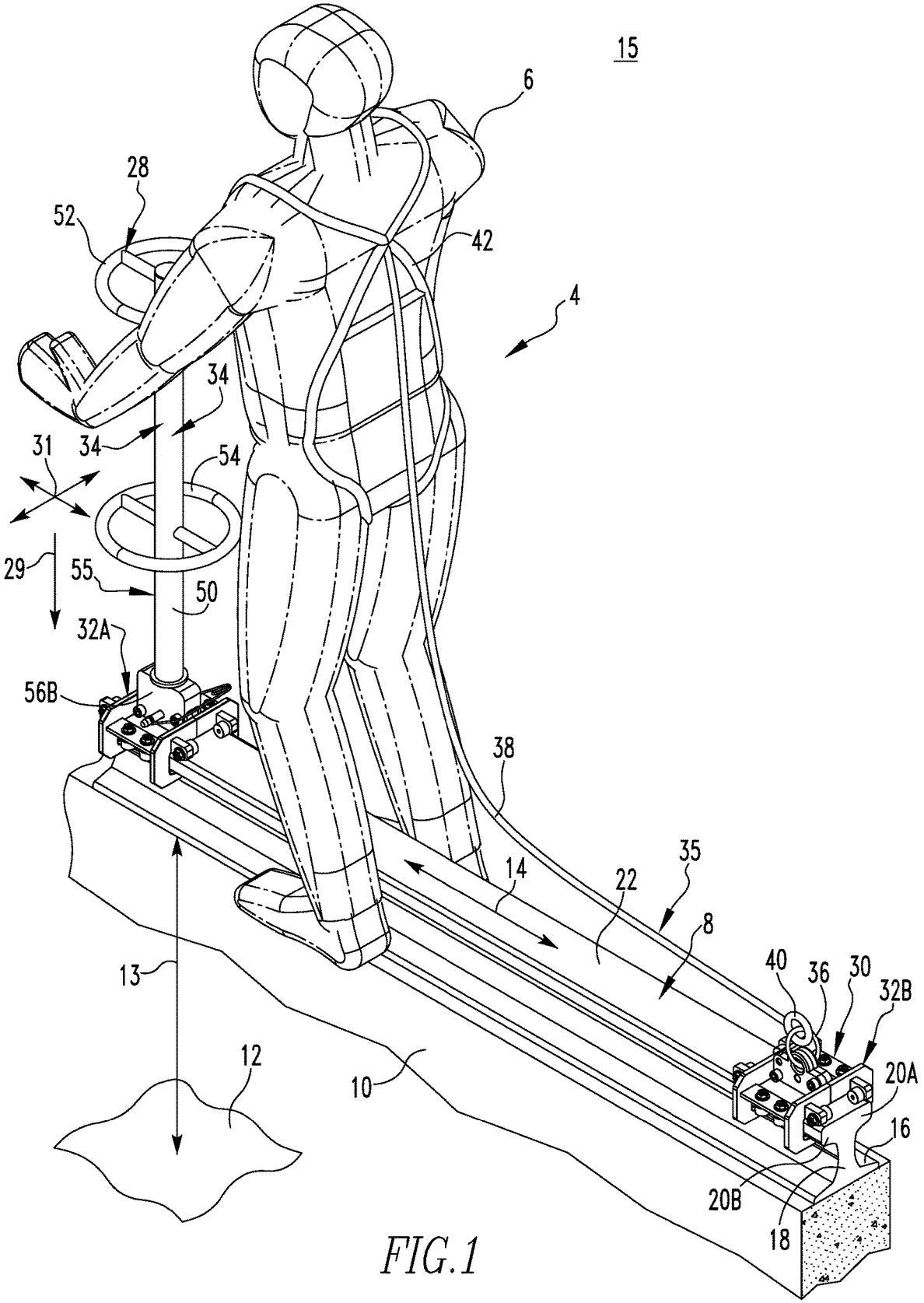
FIG. 1 is a perspective view of an improved safety system in accordance with the disclosed and claimed concept connected with a rail of an overhead crane and being used by a worker to perform an inspection operation on the rail.

As can be seen in FIG. 1, an improved safety system 4 advantageously helps a worker 6 to remain situated above a rail 8 during an inspection operation, maintenance operation, or other operation on the rail 8. As can be understood from the FIG. 1, the rail 8 is situated on some type of structure 10 of a facility 15 and thus is disposed at a significant distance 13 above a floor 12 of the facility 15. The rail 8 is elongated along a direction of elongation 14. In a situation where the direction of elongation 14 is an arcuate or circular direction, such as in the instance when the facility 15 is a circular facility, an example of which would be when the rail 8 is situated within a nuclear containment, the direction of elongation 14 will be, for any given point along the rail 8, a tangent to the arc of the rail 8.

The rail 8 can be said to include a base 16 that is mounted to the structure 10 and a web 18 that is situated atop the base 16. The web 18 can be said to include a pair of lugs 20A and 20B that each extend away from one another in a direction transverse to the direction of elongation 14. The rail 8 includes an upper surface 22 atop the lugs 20A and 20B. The rail 8 further includes an undersurface 23 that includes a pair of lower surfaces 24A and 24B that are disposed generally adjacent the base 16 underneath the lugs 20A and 20B, respectively. The rail 8 additionally includes a pair of lateral surfaces 26A and 26B that can be said to extend between the upper surface 22 and the lower surfaces 24A and 24B, respectively.

As is further shown in FIG. 1, the safety system 4 can be said to include a fall resistance apparatus 28 and a fall protection apparatus 30. The fall resistance apparatus 28 advantageously provides support to the worker 6 in a downward vertical direction 29 and in a number of lateral directions 31 transverse to the vertical direction 29 during the operation and is connected directly with the rail 8. As employed herein, the expression "a number of" and variations thereof shall refer broadly to any non-zero quantity, including a quantity of one. In the depicted exemplary embodiment, the fall resistance apparatus 28 provides support to the worker 6 in all lateral directions 31 that are transverse to the vertical direction 29.

By providing to the worker 6 vertical and lateral support along the directions 29 and 31, the fall resistance apparatus 28 resists the likelihood of the worker 6 losing balance and having a fall event. If, however, a fall event should occur, the fall protection apparatus 30 affixes the worker 6 to the rail 8 and suspends the worker 6 at a position elevated above the floor 12, thereby protecting the worker 6 from injury due to striking the floor 12 as a result of a fall event.

Figure 4:
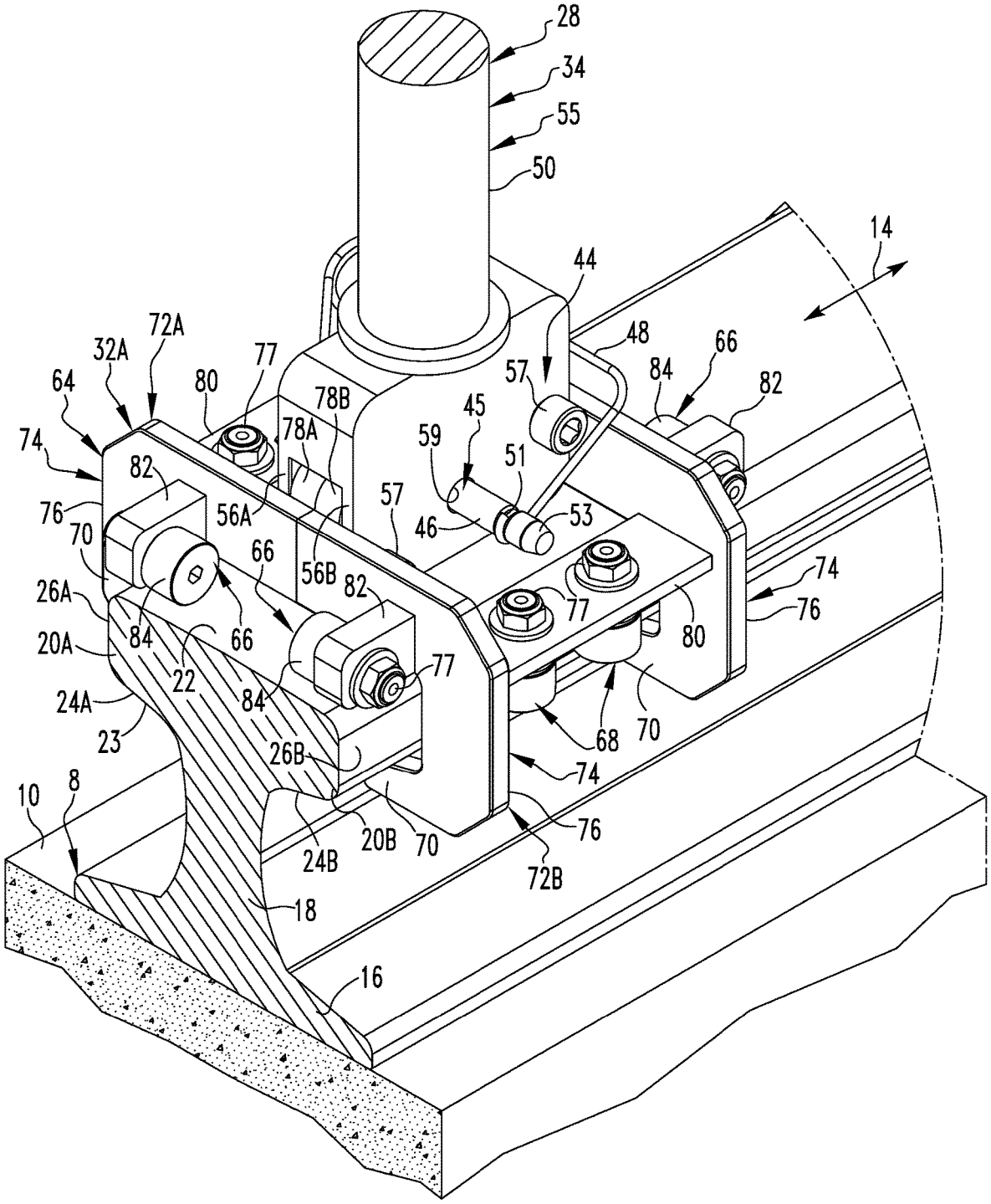
FIG. 4 is a perspective view of a trolley of a fall resistance apparatus of the safety system of FIG. 1.
Figure 5:
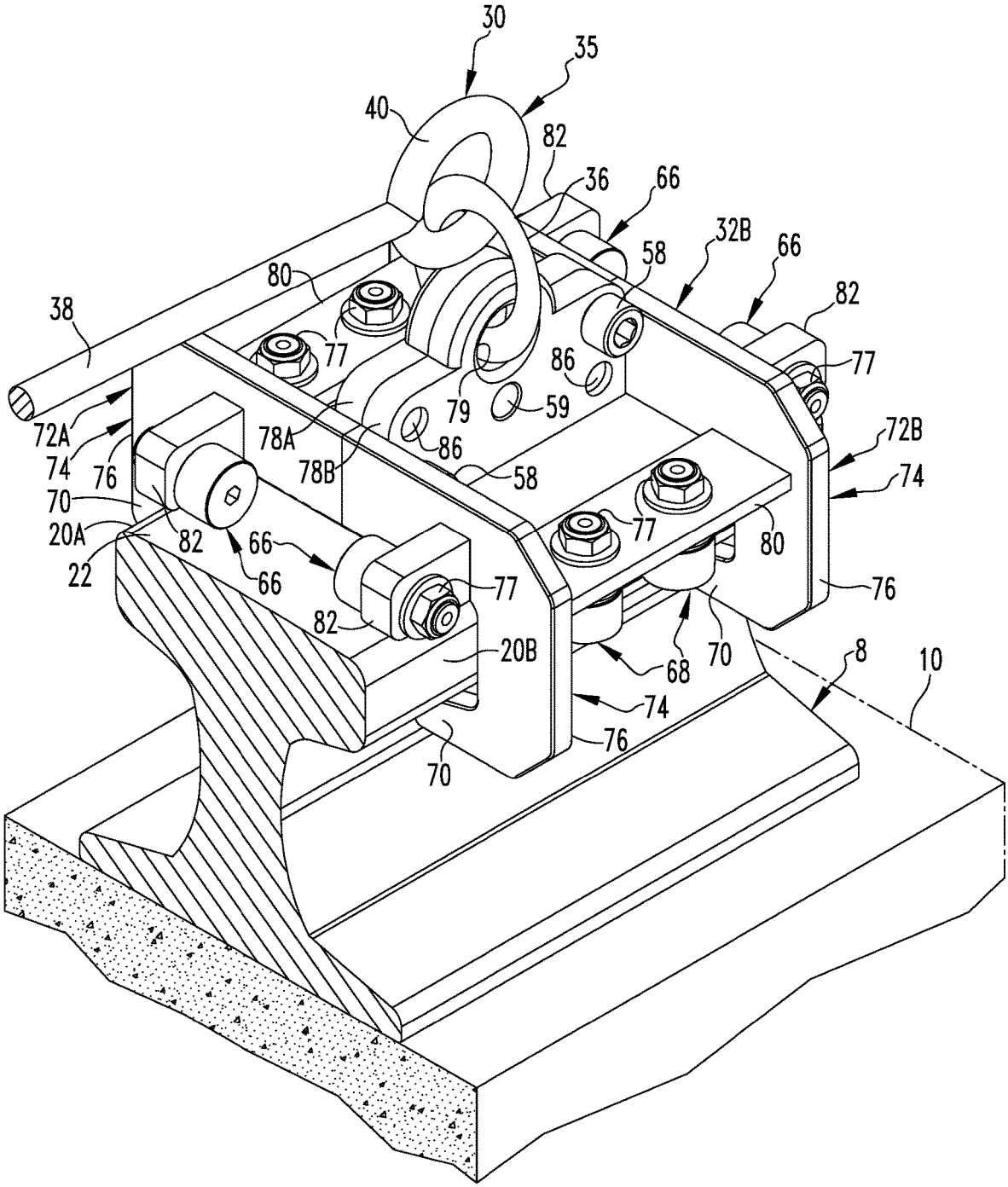
FIG. 5 is a perspective view of a portion of a fall protection apparatus of the safety system of FIG. 1.

As can be seen in FIGS. 1 and 4, the fall resistance apparatus 28 can be said to include a trolley 32A and a support 34 that are connected together. As can be seen in FIGS. 1 and 5, the fall protection apparatus 30 can be said to include a trolley 32B and an attachment apparatus 35 that are connected together. The attachment apparatus 35 can be connected with the worker 6, as is shown in FIG. 1. It is expressly noted that the trolleys 32A and 32B are, in the depicted exemplary embodiment, identical to one another. The trolleys 32A and 32B thus can be collectively or individually referred to herein with the numeral 32.

Figure 6:
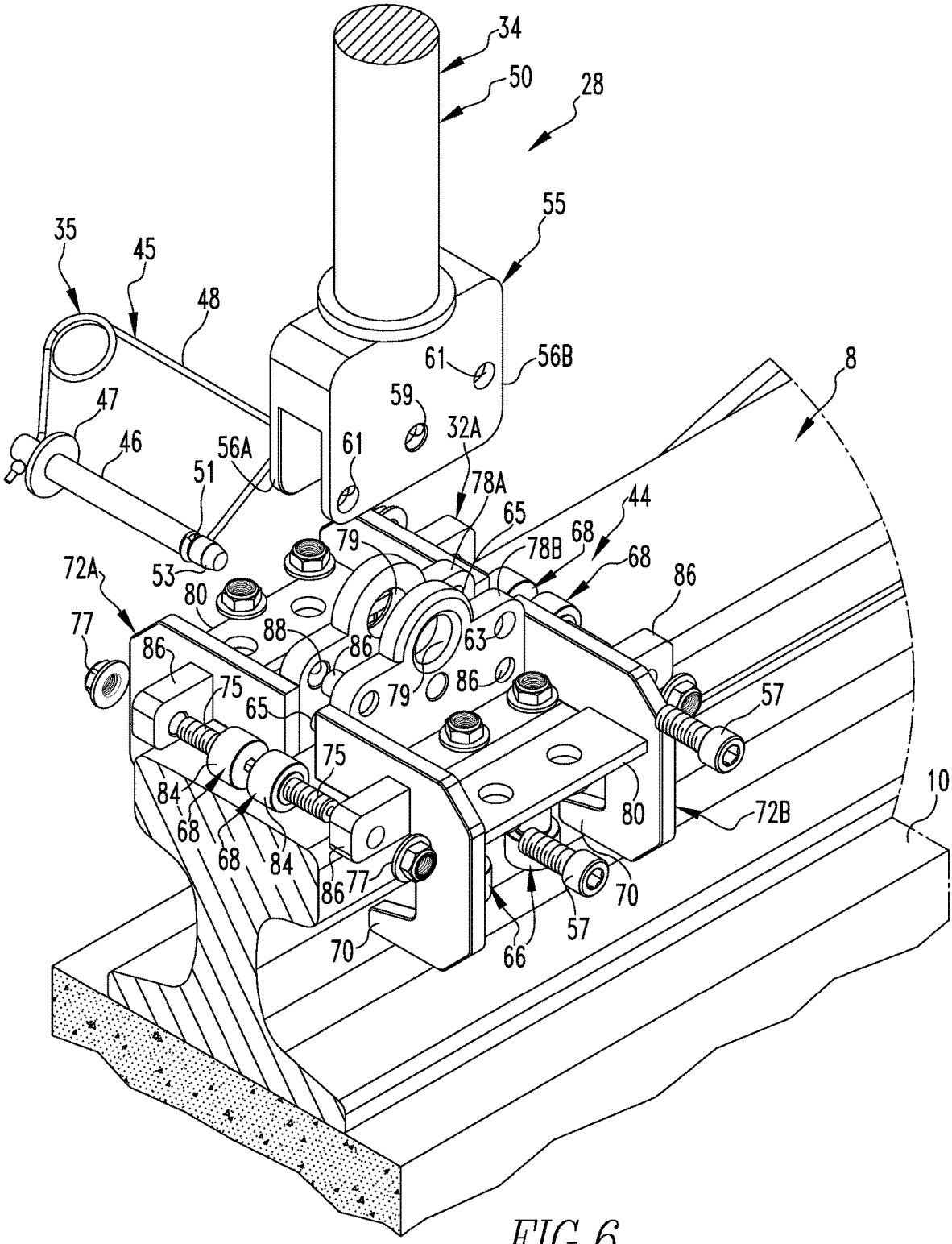
FIG. 6 is an exploded version of FIG. 4.

As can be seen in FIGS. 4 and 6, the support 34 can be said to include a connection apparatus 44 that includes a pin apparatus 45 having an elongated pin 46 and further having a spring loaded hasp 48. A first end of the hasp 48 is mounted to a first end of the pin 46 adjacent a washer 47 of the pin apparatus 45. A second end of the hasp 48 is removably receivable in an indentation 51 that is formed in the pin 46 adjacent a beveled end 53 of the pin 46 opposite the washer 47. The connection apparatus 44 further includes a pair of fasteners 57 that are in the exemplary form of threaded screws.

The support 34 further includes a brace 55 that is connectable to the trolley 32A using the connection apparatus 44. The brace 55 includes an elongated stanchion 50, an upper handgrip 52 situated at an end of the stanchion 50 opposite the trolley 32A, and a lower handgrip 54 that is situated on the stanchion 50 between the upper handgrip 52 and the trolley 32A. The brace 55 further includes a pair of ears 56A and 56B that are situated at an end of the stanchion 50 opposite the upper handgrip 52. The pair of ears 56A and 56B are mounted to the trolley 32A using the connection apparatus 44.

As can be understood from FIGS. 1 and 5, the attachment apparatus 35 of the fall protection apparatus 30 includes a connector 36 that is connected with the trolley 32B and that is also connected with an umbilical 38 and, more specifically, a loop 40 of the umbilical 38. An end of the umbilical 38 opposite the trolley 32B is connected with a harness 42 that is connectable to the worker 6, or the umbilical 38 at an end thereof opposite the trolley 32B can be otherwise connected with the worker 6. The attachment apparatus 35 further includes a pair of fasteners 58 that are similar to the fasteners 57. It is noted, however, that the fasteners 57 are each longer than the fasteners 58 since the fasteners 57 must extend through the ear 56B in addition to a portion of the trolley 32A, whereas the fasteners 58 extend only through a portion of the trolley 32B, as is explained in greater detail elsewhere herein.

The trolleys 32 each include a frame 64, a number of first rollers 66 (a quantity of four in the depicted exemplary embodiment), a number of second rollers 68 (a quantity of four in the depicted exemplary embodiment), and a number of hooks 70 (a quantity of four in the depicted exemplary embodiment). The frame 64 can be said to include a pair of frame halves 72A and 72B that are similar to one another and that are arranged in an opposed fashion to mount the frame 64 directly to the rail 8. Each frame half 72A and 72B can be said to include a pair of legs 74. Each leg 74 includes a body 76 and further includes one of the hooks 70 in a fashion such that the hook 70 protrudes from the corresponding body 76. As will be set forth in greater detail below, the hooks 70 are engageable with the lower surfaces 24A and 24B to retain the trolley 32 on the rail 8 in certain circumstances.

Each frame half 72A and 72B further includes a mounting plate 78A and 78B, respectively, that extends between the pair of legs 74 of the frame half 72A and 72B, respectively. The mounting plates 78A and 78B are positioned on each such frame half 72A and 72B such that the pair of mounting plates 78A and 78B of each trolley 32 are positioned opposing one another and physically engaged with one another when the frame halves 72A and 72B are connected together on the rail 8. The exemplary mounting plates 78A and 78B extend vertically upwardly from the rail 8 and protrude above an upper edge of the pair of legs 74 in order to provide a large surface area having holes formed therein through which the fasteners 57 and the pin 46 in the case of the trolley 32A, or the fasteners 58 in the case of the trolley 32B, can be received in order to affix together the mounting plates 78A and 78B and to thereby mount the trolley 32 to the rail 8. For instance, the lug 20A is received between the pair of bodies 76 and the pair of hooks 70 of the frame half 72A, and the lug 20B is received between the pair of bodies 76 and the pair of hooks 70 of the frame half 72B. Then, the fasteners 57 and the pin 46 in the case of the trolley 32A, and the fasteners 58 in the case of the trolley 32B, are installed on the mounting plates 78A and 78B to affix together the frame halves 72A and 72 and to mount the trolley 32 to the rail 8.

Figure 7:
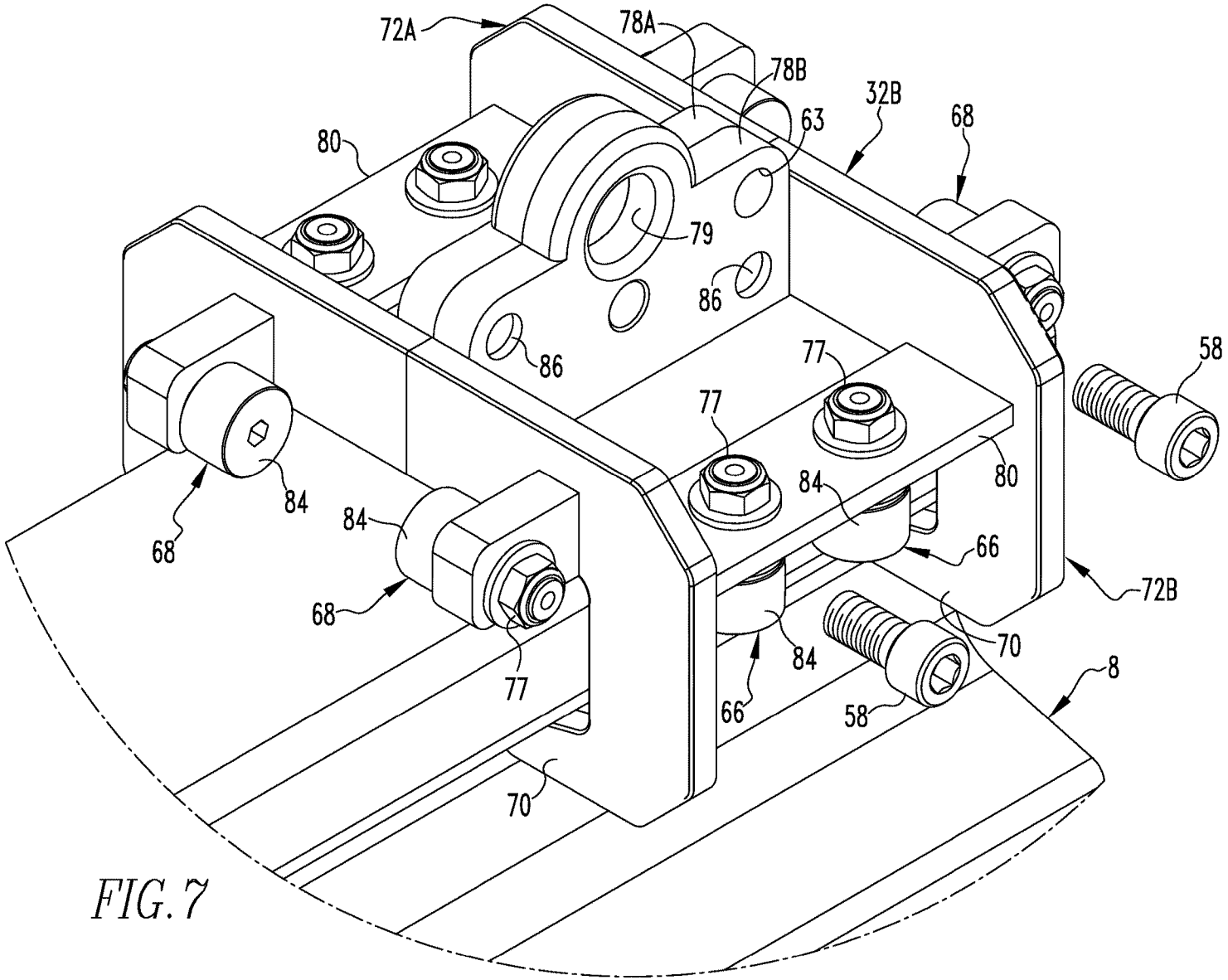
FIG. 7 is an exploded version of FIG. 5.

More specifically, and in the case of the trolley 32A, the fasteners 57 are received in a first direction through a pair of holes 61 that are formed in the ear 56B and thereafter through a pair of thru-holes 63 (only one of which is expressly depicted in FIGS. 6 and 7 for purposes of clarity) that are formed in the mounting plate 78B. The fasteners 57 are then threaded into a pair of threaded holes 65 that are formed in the mounting plate 78A. A mounting hole 67 is formed in each of the ears 56A and 56B, and a further hole 69 is formed in each of the mounting plates 78A and 78B, with the pin 46 being received through such holes 67 and 69, and with the free end of the hasp 48 being received in the indentation 51. In the case of the trolley 32B, the fasteners 58 are received in the first direction through the pair of thru-holes 63 that are formed in the mounting plate 78B and are then threaded into the pair of threaded holes 65 that are formed in the mounting plate 78A. The fasteners 57 and the pin apparatus 45 thus affix together the support 34 to the trolley 32A and affix together the frame halves 72A and 72B to mount the trolley 32A to the rail 8. The fasteners 58 affix together the frame halves 72A and 72B to mount the trolley 32B to the rail 8. The fasteners 57 and the pin apparatus 45 are removable to enable the support 34 to be removed from the trolley 32A, such as for storage and transportation, etc., and the same can be said of the fasteners 58. The mounting plates 78A and 78B each additionally have a further hole 79 formed therein through which the connector 36 is received on the trolley 32B.

As can be seen in the drawings, each frame half 72A and 72B further includes a buttress 80 that extends between the bodies 76 of the pair of legs 74 thereof. A pair of the second rollers 68 is rollably situated on each buttress 80. Each frame half 72A and 72B further includes a pair of tabs 82, with the tabs 82 being situated on the legs 74 and extending generally away from one another in directions parallel with the direction of elongation 14. Each tab 82 has one of the first rollers 66 rollably situated thereon. The first and second rollers 66 and 68 each have a threaded shank 75 that is cooperable with a threaded nut 77 and further has an engagement structure 84 that is rollably situated on the shank 75. The engagement structures 84 are rollably engageable with the rail 8 when the trolley 32 is mounted to the rail 8.

In order to assemble the fall resistance apparatus 28, the frame halves 72A and 72B of the trolley 32A are positioned such that the mounting plates 78 are engaged with one another and such that the hooks 70 are situated underneath the lugs 20A and 20B. The pair of mounting plates 78A and 78 are engaged with one another to cause a pair of alignment protrusions 86 that are formed on the mounting plate 78B to be received in a pair of holes 88 (only one of which is shown in FIG. 6 for reasons of clarity) that are formed in the mounting plate 78A. In the case of the trolley 32A, the pair of mounting plates 78A and 78 are then received between the pair of ears 56A and 56B. The fasteners 57 and the pin apparatus 45 are then received on the support 34 and the mounting plates 78A and 78B as set forth elsewhere herein. It will be understood that the ears 56A and 56B are situated with respect to one another on the stanchion 50 in locations spaced apart from one another such that the mounting plates 78A and 78B will remain tightly engaged with one another and interposed between the ears 56A and 56B when the fasteners 57 and the pin apparatus 45 have been received in the corresponding holes 59 formed therein. In the case of the trolley 32B, the fasteners 58 are received on the mounting plates 78A and 78B as set forth elsewhere herein.

As can be understood from the accompanying drawings, the fall resistance apparatus 28 is mounted to the rail 8 such that the support 34 is situated generally to the front of the worker 6, i.e., along the direction of elongation 14. The fall protection apparatus 30 is installed such that the trolley 32B is mounted on the rail 8 situated generally to the rear of the worker 6, i.e., along the direction of elongation 14. Since the brace 55 extends in an upward direction from the trolley 32A situated on the rail 8, the stanchion 50 can be manually grasped by the worker 6 in order to support the worker 6 and to enable the worker 6 to maintain balance on the structure 10 in the vicinity of the rail 8. Additionally or alternatively, the worker 6 can manually grasp the upper handgrip 52, the lower handgrip 54, or both, in order to maintain stability upon the structure 10 in the vicinity of the rail 8. By providing both the upper handgrip 52 and the lower handgrip 54, the user can get down on the worker's knees, for example, to more closely inspect a part of the rail 8, etc., and can safely return to a standing position, with lateral and vertical stability being provided for such movements of the worker 6 by the fall resistance apparatus 28.

As can be understood from the drawings, the first rollers 66 are generally engaged with the upper surface 22 of the web 18, and the second rollers 68 are engaged with the lateral surfaces 26A and 26B. In the depicted exemplary embodiment, the first and second rollers 66 and 68 are friction reduction elements which reduce friction between the frame 64 and the rail 8 and which enable the trolley 32 to move along the rail 8 with reduced friction as compared with the absence of the first and second rollers 66 and 68. In the depicted exemplary embodiment, such reduced friction is provided by causing the friction reduction elements to be in the form of the first and second rollers 66 and 68 that are rollably situated on the trolley 32 and that rollably engage the rail 8. It is understood, however, that in other embodiments the first and second rollers 66 and 68 can be replaced with other friction reduction elements such as blocks formed of Delrin or other appropriate reduced friction material without departing from the spirit and scope of the instant disclosure.

It can further be understood that the second rollers 68 are generally engaged with the lateral surfaces 26A and 26B at all times. That is, the web 18 is interposed between the second rollers 68 on the frame half 72A and the second rollers 68 on the other frame half 72B inasmuch as the second rollers 68 are positioned on the frame 64 to provide essentially no space between the second rollers 68 and the lateral surfaces 26A and 26B. This retains the web 18 interposed between the second rollers 68.

Figure 2:
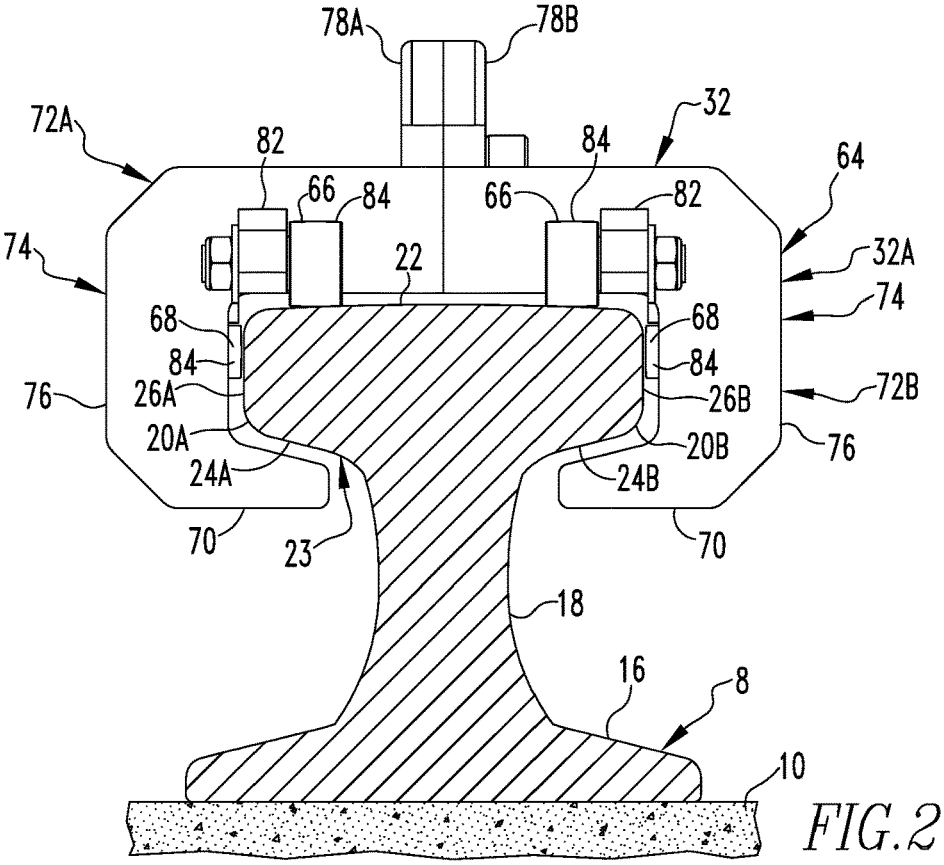
FIG. 2 is an end view of a trolley of the safety system of FIG. 1 situated on the rail.

In contrast, the first rollers 66 are intended to be rollably engaged with the upper surface 22 when, for example, the trolley 32 is stationary on the rail 8 and no forces other than gravity are being applied thereto. In such a situation, the first rollers 66 are engaged with the upper surface 22, and the hooks 70 are spaced slightly from the lower surfaces 24A and 24B, as can be seen in FIG. 2. As the fall resistance apparatus 28 and the fall protection apparatus 30 are moved along the rail 8 along the direction of elongation 14, such as during normal progress of the maintenance or inspection operation on the rail 8, the first rollers 66 generally remain rollably engaged with the upper surface 22, and the hooks 70 generally remain spaced from and disengaged from the lower surfaces 24A and 24B. However, and as is demonstrated in FIG. 3, if the worker 6 applies a force 90 to the support 34, such as in the fore-aft direction or in the left-right direction (or a combination thereof), and which may or may not include a force component in the up-down direction, the trolley 32A will be caused to pivot slightly with respect to the rail 8.

Figure 3:
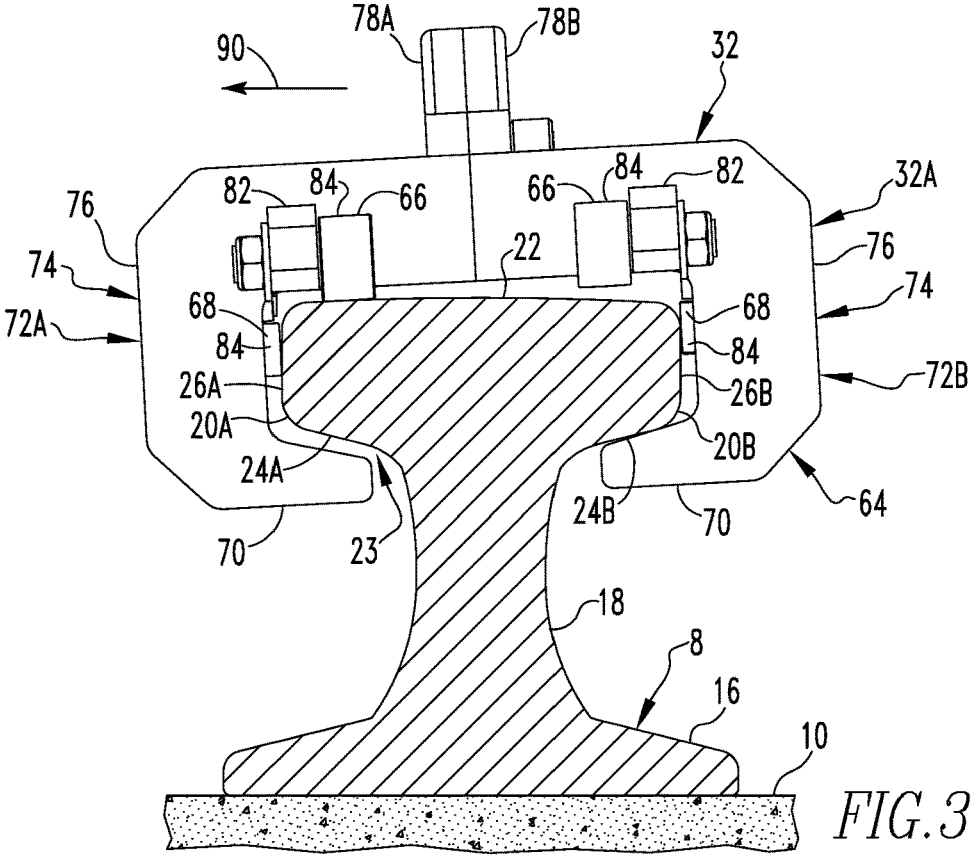
FIG. 3 is a view similar to FIG. 2, except depicting the trolley engaged with an underside of the rail and thus in a protective position when subject to loading in a lateral direction.

Such pivoting of the trolley 32A, as in FIG. 3, will cause one or more of the first rollers 66 to become disengaged with the upper surface 22 and will instead cause one or more of the hooks 70 to become engaged with the lower surfaces 24A and 24B, as the case may be, which frictionally retains the trolley 32A in a given position on the rail 8. Such retaining of the trolley 32A at such a position locks the fall resistance apparatus 28 in place and provides support along the fore-aft direction, the left-right direction, and the up-down direction to permit the worker 6 to become stabilized and to maintain balance. It is noted that the exemplary force is indicated at the arrow 90 as being applied to the trolley 32A. It is understood that any such force applied to either of the trolleys 32A and 32B will result in such trolley 32 being retained on the rail 8.

Once the worker 6 achieved balance and the force 90 on the support 34 is removed, the trolley 32 will return to its natural neutral position in which the first rollers 66 are rollably engaged with the upper surface 22 and the hooks 70 are disengaged from the lower surfaces 24A and 24B. In such a situation, the fall resistance apparatus 28 can be further translated along the longitudinal extent of the rail 8 in the direction of elongation 14 to permit the maintenance operation or other operation on the rail 8 to continue.

As the worker 6 walks along the rail 8 along the direction of elongation 14, the umbilical 38 pulls the trolley 32B along the longitudinal extent of the rail 8 in the direction of elongation 14. In such a situation, the first rollers 66 of the trolley 32B are rollably engaged with the upper surface 22 of the web 18, and the hooks 70 of the trolley 32B are spaced from and disengaged from the lower surfaces 24A and 24B. However, if a fall event should occur, the umbilical via the loop 40 and the connector 36 will apply a lateral force to the trolley 32B, such as the force 90, which is depicted in FIG. 3 as being applied to the trolley 32A, thereby causing one or more of the first rollers 66 thereof to become disengaged from the upper surface 22 and to thus cause one or more of the hooks 70 to become engaged with the lower surfaces 24A and 24B, as the case may be, which causes the trolley 32B to be frictionally locked in place on the rail 8. In such a situation, the fall protection apparatus 30 suspends the worker 6 from the rail 8 a distance above the floor 12 which advantageously avoids injury to the worker 6 by avoiding the worker 6 falling onto the floor 12. Once the force has been removed from the trolley 32, such as when the worker 6 has been returned to being atop the structure 10, the first rollers 66 of the trolley 32B are returned to being rollably engaged with the upper surface 22, which causes the hooks 70 of the trolley 32B to become spaced from and thus disengaged from the lower surfaces 24A and 24B. This, in turn, permits the trolley 32B of the fall protection apparatus 30 to move farther along the rail 8 along the direction of elongation 14 as the maintenance or other operation continues to be performed on the rail 8.

It thus can be seen that the improved safety system 4 advantageously enhances the safety of the worker 6 during the maintenance or inspection or other operation on the rail 8 by being engaged directly with the rail 8 and by providing the fall resistance apparatus 28, which provides support to the worker 6 during the course of the operation on the rail 8, in addition to the fall protection apparatus 30. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A safety system usable by a worker during an inspection operation of a rail that is elongated, the rail having a base and further having a web that is situated atop the base, the safety system comprising:

a fall resistance apparatus comprising a first trolley that is structured to be situated on the rail and a support that is situated on the first trolley, the support being elongated and being structured to extend in a generally upward direction from the first trolley;

a fall protection apparatus comprising a second trolley that is structured to be, situated on the rail and an umbilical that is connected with the second trolley, the umbilical being elongated and structured to be affixed to the worker at an end of the umbilical opposite the second trolley; and the first and second trolleys each comprising a frame having a number of engagement structures and a number of hooks, the frame being structured to be situated on the rail with at least some of the engagement structures of the number of engagement structures being engaged with an upper surface of the web and with the number of hooks being spaced below a lower surface of the web opposite the upper surface when the frame is free of lateral loading, at least a first hook of the number of hooks being structured to engage the lower surface and resist movement of the frame with respect to the rail when the frame is subjected to lateral loading, and at least a first engagement structure of the number of engagement structures is at least partially disengaged from the upper surface.

2. The safety system of claim 1 wherein the number of engagement structures comprise a number of friction reduction elements.

3. The safety system of claim 1 wherein a first portion of the friction reduction elements of the number of friction reduction elements are ctured to engage the upper surface, and wherein a second portion of the friction reduction elements of the number of friction reduction elements are structured to engage at least one of a first lateral surface of the web and a second lateral surface of the web that each extend generally between the upper surface and the lower surface at opposite sides of the web.

4. The safety system of claim 3 wherein a first subset of the friction reduction elements of the second portion are structured to engage the first lateral surface and wherein a second subset of the friction reduction eler ents of the second portion are structured to engage the second lateral surface whether the first portion of the friction reduction elements are engaged with the upper surface or are disengaged therefrom.

5. The safety system of claim 2 wherein the number of friction reduction elements are one of rollers that are rotatably situated on the frame and sliders in the form of blocks formed of a reduced friction material that are immovably situated on the frame.

6. The safety system of claim 2 wherein at least some of the friction reduction elements of the number of friction reduction elements are rollers that are rotatably situated on the frame.

7. The safety system of claim 1 wherein the fall resistance apparatus comprises a handgrip that is situated on the support at an end thereof opposite the first trolley and that is structured to be manually grasped by the worker during the inspection operation.

8. The safety system of claim 7 wherein the fall resistance apparatus comprises another handgrip that is situated on the support between the handgrip and the first trolley and that is structured to be manually grasped by the worker during the inspection operation.

9. The safety system of claim 1 wherein the web has a first lug that extends outwardly from the base in a first direction transverse to a direction of elongation of the web, the web having a second lug that extends outwardly from the base in a second direction transverse to the direction of elongation and opposite the first direction, and wherein the lower surface of the web is an undersurface of one of the first lug and the second lug.

10. The safety system of claim 1 wherein the fall resistance apparatus is structured to be situated on the rail with the support being structured to be disposed to the front of the worker and to be manually grasped by the worker during the inspection operation.

11. The safety system of claim 1 wherein the fall protection apparatus is structured to be situated with the second trolley disposed on the rail to the rear of the worker, the fall protection apparatus being structured to suspend the worker from the rail at a location situated above the floor in the event of a fall during the inspection operation.

* * * * *